United States Patent [19]

Aigner et al.

[11] Patent Number: 4,980,523

[45] **Date of Patent: * Dec. 25, 1990**

[54] APPLIANCE PROGRAMMER/TIMER WITH BI-DIRECTIONAL DRIVE

[75] Inventors: Robert K. Aigner, Chicago; Robert A. Livernash, Naperville; Joseph J. Mahon, Libertyville, all of Ill.

[73] Assignee: Eaton Corporation, Cleveland, Ohio

[ * ] Notice: The portion of the term of this patent subsequent to Aug. 8, 2006 has been disclaimed.

[21] Appl. No.: 383,688

[22] Filed: Jul. 24, 1989

[51] Int. Cl.[5] ..... H01H 7/08; H01H 43/10

[52] U.S. Cl. ..... 200/38 R; 200/38 A; 200/38 C

[58] Field of Search ..... 200/35 R, 38 R, 38 A, 200/38 F, 38 FA, 38 B, 38 BA, 38 C, 38 CA

[56] References Cited

U.S. PATENT DOCUMENTS

| | | | |
|---|---|---|---|
| 4,366,352 | 12/1982 | Obermann | 200/35 R |
| 4,611,103 | 9/1986 | Eder et al. | 200/38 B |
| 4,796,484 | 1/1989 | Eder | 200/38 B X |
| 4,856,096 | 8/1989 | Mahon et al. | 200/38 C |

*Primary Examiner*—J. R. Scott

*Attorney, Agent, or Firm*—R. A. Johnston

[57] ABSTRACT

A programmer for an appliance having a single timing motor drive for a rotating cam drum which actuates plural appliance program function switches. An advance pawl drives the cam drum in one direction when selectively engaged with a toothed wheel on the drum and drives through a first rotary frictional coupling. A gear train drives continuously through a second rotary frictional coupling and drives the cam drum in a reverse direction when the advance pawl is disengaged. When the pawl is engaged, the second rotary frictional coupling slips and is overdriven in a direction opposite its driving direction by said first frictional coupling.

13 Claims, 2 Drawing Sheets

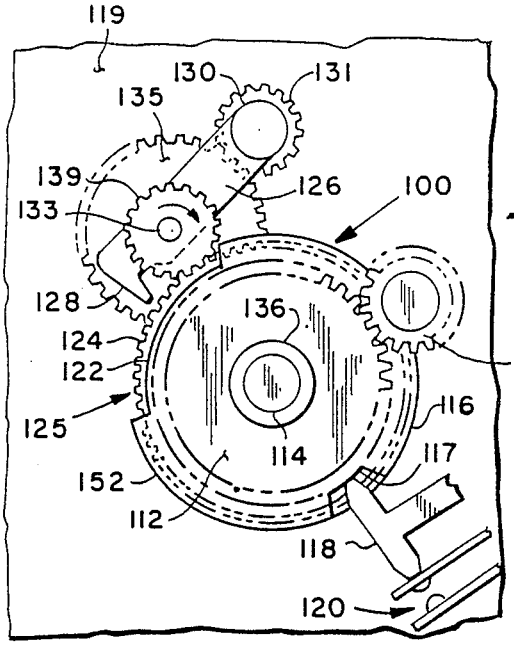
Fig. 4
Fig. 5
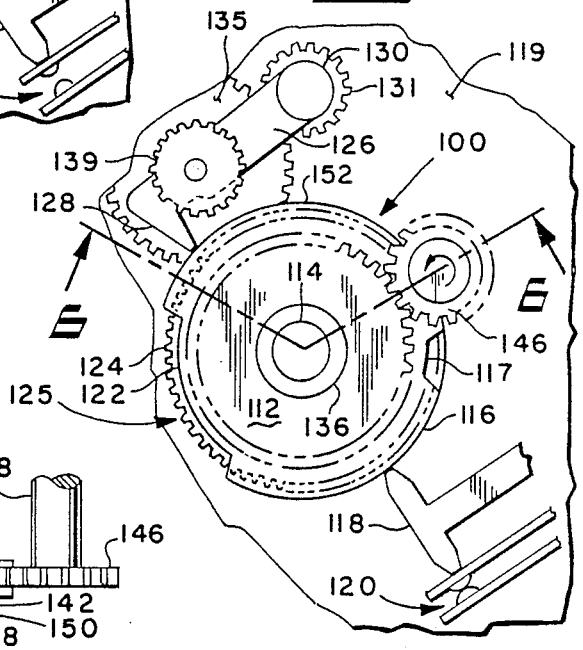
Fig. 6
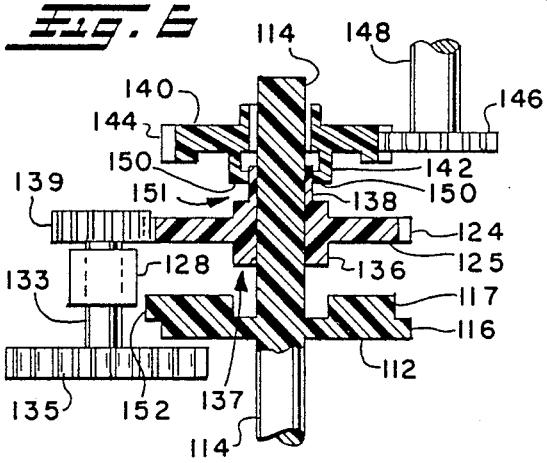
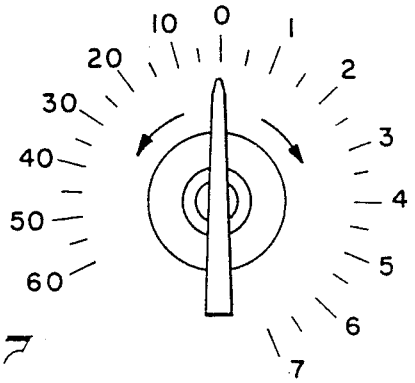
Fig. 7

APPLIANCE PROGRAMMER/TIMER WITH BI-DIRECTIONAL DRIVE

BACKGROUND OF THE INVENTION

The present invention relates to electromechanical programmers utilized for sequentially activating at least one and usually a plurality of electrical switches for a selective program interval. Programmers of this sort are commonly employed for appliances such as clothes washing machines, dishwashers, microwave ovens and other appliances wherein it is desired for the machine user to select a desired program interval for the appliance operation; and, upon such selection a timing motor provides advancement of a cam track for sequentially actuating the machine control function switches during time-out of the selected interval.

Typically, electromechanical appliance programmers utilize a subfractional horsepower synchronous timer motor driving either a continuous drive to the cam through a speed reducer, or employ an indexing mechanism such as a ratchet wheel engaged by a periodically advanced and retracted pawl.

In a copending application, Ser. No. 242,397 filed Sept. 9, 1988 now U.S. Pat. No. 4,856,096, entitled "Providing Programmer/Timer With Dual Rate Drive" and assigned to the assignee of the present invention, it is disclosed to advance a cam drum for actuating plural appliance function switches by selectively driving the drum from separate drives driven by a common motor through dual frictional couplings and allowing one such coupling to slip and be overdriven. The dual rate of advance is desired in appliance applications where it is required to have a higher degree of accuracy in setting the program interval where the selected interval is short such as five minutes or less than is required for setting the programmer for program intervals of greater length.

Heretofore however, it has only been possible to provide a programmer having the dual rate of time out sequentially in view of the unidirectional advancement of the cam drum.

However, it has been found desirable in certain appliance applications, to provide an electromechanical programmer which permits the user to select short interval programs by setting the cam drum shaft knob in one direction and longer interval programs by setting the cam drum shaft knob in the opposite direction.

Such a knob setting arrangement has the advantage that it permits the selector scale or dial to be disposed in separate sections on opposite sides of the zero of OFF position. Such an arrangement readily permits an expanded dial scale to be provided on one side for short interval selection and a compressed scale to be provided on the other side for longer interval selection. A selector scale or dial of this type, although desirable, requires that the cam drum advancement or time out drive operate in reverse when one or the other of the types of interval is selected. Heretofore it has not been practical to provide an electromechanical programmer suitable for high volume production which employs a single timing motor and is capable of such bi-directional operation and yet is not prohibitively costly for household appliances.

SUMMARY OF THE INVENTION

The present invention provides an electromechanical programmer for appliances with plural appliance function switches operatively following a cam track on a rotating cam drum. A relatively fast rate of advance of the switch cam track is provided when the cam drum shaft is turned by the user in one direction from the zero or "OFF" position; and, the programmer has a slower rate of advance when the cam drum shaft is turned by the user in the opposite direction from the "Off" position for selecting a desired program interval. In the fast rate of advance mode, a first disengageable cam advance means is connected to drive the cam drum by a first frictional coupling means; and, a second advance means, which is preferably a continuous drive, is connected for driving the ratchet by a second frictional coupling means which is permitted to slip and is overdriven when the first advance means is engaged for advancing the drum. The cam drum has an auxiliary cam track user positionable with the drum and operative for disabling the first advance means, whereupon the second frictional coupling ceases to slip and the continuous drive provides for the slower rate of advance.

User selection of the desired program interval for the cam track is accomplished by user rotation of the cam drum shaft knob in either a clockwise or anticlockwise direction which is permitted by slippage of the first frictional coupling to enable the desired positioning of the cam track for commencement of the timed interval for the program.

In the preferred form, the first frictional means comprises a frictional engagement between the interior of the hub on a toothed wheel attached to the drum and a shaft connected to the cam drum. The second frictional coupling means preferably comprises a collet provided on a motor speed reducer output gear with the collet frictionally engaging the toothed wheel hub on the cam drum; however, alternatively, the second frictional coupling could be directly to the shaft. In one embodiment, the first advance means comprises an oscillating advance pawl engaging the toothed wheel; and, in another embodiment, the first advance means comprises a gear pivoted on an arm for engaging the toothed wheel.

The present invention thus provides a novel and simplified construction for an electromechanical programmer for appliances wherein a single drive motor is operative to provide bi-directional cam drum advancement through a first advance means driving a toothed wheel which drives the drum through a first frictional coupling. A second advance means is operative to drive the cam drum in the opposite direction and at a slower rate with a continuous drive to the cam drum shaft through the second frictional coupling which slips and is overdriven during operation of the faster first advance means. The fast advance means is activated by user knob rotation in one direction from the "OFF" position, and the opposite slower advance means is activated by user knob rotation in the opposite direction from the "OFF" position.

BRIEF DESCRIPTION OF THE DRAWINGS

FIG. 4 is a view similar to FIG. 1 of another embodiment of the first advance means employing a gear pivoted on an arm, and in engagement with the toothed member;

FIG. 5 shows the arm of FIG. 4 raised by an auxiliary cam track to disengage the gear from the toothed member;

FIG. 6 is a section view taken along section indicating line 6—6 of FIG. 5; and

FIG. 7 is a view of the indicator dial employed for bi-directional user setting of the cam drum shaft.

DETAILED DESCRIPTION

Figure 1:
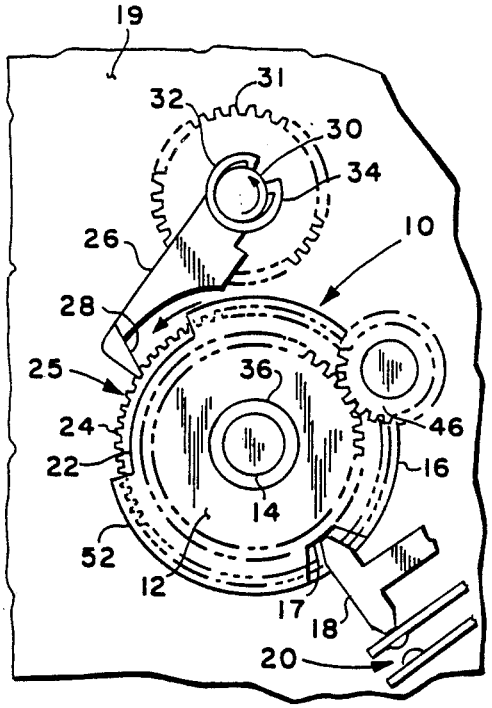
FIG. 1 is a pictorial representation of one embodiment of the programmer with a first advance means comprising an oscillating advance pawl engaging a toothed wheel.

Referring to FIG. 1, the present programmer having a bi-directional, dual rate drive mechanism is illustrated generally by reference numeral 10 and includes a drum 12 mounted for rotation about shaft 14 and having a program cam track 16 provided about the periphery thereof. A cam follower means 18 is pivotally disposed on the base or housing means 19 and the follower is engaged in track 16 and is operative to effect actuation and deactuation of the typical electrical appliance program function switch mechanism indicated generally at 20. It will be understood that additional program functions switches may be disposed on the base means 19 for operation by the cam drum 12, but have been omitted in the drawings for simplicity of illustration. In the illustration of FIG. 1, the cam drum 12 is shown rotated to a position such that the cam follower 18 rests against the depressed or base circle portion 17 of cam track 16; and, in this position effects deactuation or opening of the switch 20. The portion of cam track 16 on drum 12 disposed generally diametrically opposite the depressed portion 17 is also depressed for a desired arcuate segment of the cam track periphery as indicated by the reference numeral 22.

A first advance means includes a toothed member comprising a ratchet wheel indicated generally at 25 having teeth 24, of substantially constant pitch, but with root diameter greater than track 22, are formed about the periphery thereof. The ratchet 25 is disposed concentrically with respect to shaft 14 and is effective upon rotation for advancing drum 12.

In the embodiment of FIG. 1 an oscillating advance pawl 26 is provided and has a chisel point 28 pivotally disposed to engage the ratchet teeth 24 as illustrated in FIG. 1. Pawl 26 is connected to eccentric rotating crank pin 30 at the end thereof opposite to the point 28 biased thereon by a retaining ring having integrally formed spring fingers 34,32. It will be understood that the eccentric 30 is rotated by a speed reducer gear 31 and motor drive mechanism (not shown) engaging gear 31.

Figure 2:
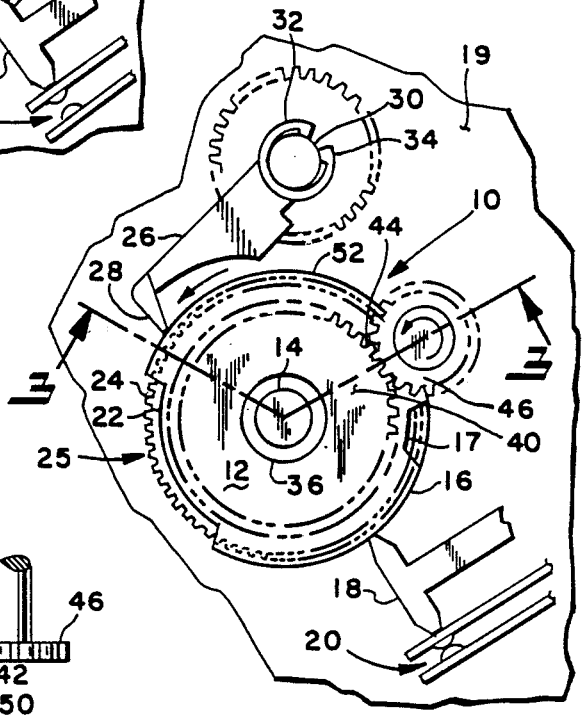
FIG. 2 is a view similar to FIG. 1 showing the advanced pawl lifted from the toothed wheel by a blocking track on the cam.
Figure 3:
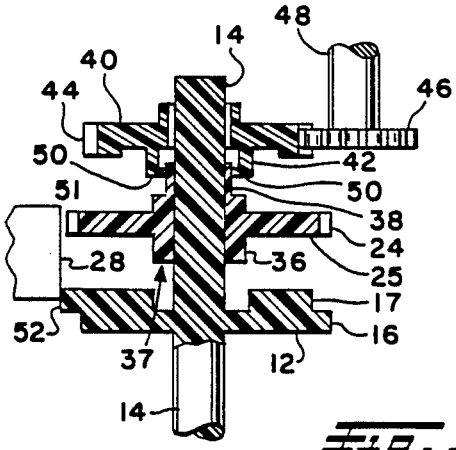
FIG. 3 is a section view taken along broken section line 3—3 of FIG. 1.

Referring to FIGS. 1, 2 and 3, the cam drum 12 is illustrated in the preferred practice as being integrally formed on shaft 14 and is rotated therewith in a clockwise direction by user rotation of the shaft 14 for positioning the cam track 16 at a desired rotational position with respect to cam follower 18 for selecting the desired program interval for time out and for determining whether cam advance is effected at the faster rate of advance by pawl 22 and ratchet 25. With reference to FIG. 7, the aforesaid faster rate of advance is achieved by user positioning of the shaft 14 by turning indicator knob 15 clockwise to the desired time out interval on the dial scale 0–7.

Referring to FIG. 3, ratchet wheel 25 is shown as having an axially extending hub 36 which has the inner periphery thereof received over shaft 14 so as to position the ratchet teeth 24 in axial alignment for engagement with the pawl chisel point 28. The ratchet hub engages the shaft 14 in a frictional engagement and comprises a first rotary frictional coupling indicated generally by the numeral 37 for operatively connecting the ratchet wheel 25 for rotationally driving cam drum 12. The ratchet hub 36 has a reduced diameter extension portion 38 extending from the hub in a direction opposite that of the cam drum 12.

A speed reducing gear 40 has a central hub 42 provided thereon and received over shaft 14 adjacent the reduced diameter portion 38 of the ratchet hub. Gear 40 has peripheral teeth 44 continuously engaged by a motor drive pinion gear 46 which is driven from shaft 48 by a motor (not shown). The drive pinion 46 is rotated in a clockwise direction so as to rotate the toothed member 25, along with drum 12 in a reverse or counterclockwise direction through a second rotary frictional coupling 51. It will be understood that a common drive motor (not shown) may be employed with appropriate speed reduction for the eccentric shaft 30 and for the pinion gear 46.

The hub 42 of gear 40 has provided on the interior thereof a plurality of collet jaws 50 which frictionally engage the exterior of the smaller hub diameter 38 in frictional engagement and comprise second rotary frictional coupling 51 in FIG. 3 for providing a continuous drive from shaft 48 to toothed member 25 via gear 44 and through the first rotary frictional coupling 31 to the cam drum 12.

Referring to FIG. 2, the drive of FIG. 1 is shown with the cam drum 12 rotated to a position where an auxiliary cam track 52 has raised the chisel point 28 an amount sufficient to disengage the pawl from the ratchet teeth 24. This lifted position is shown in greater detail in FIG. 3.

In operation, when the cam drum 12 is positioned such that track 22 permits the ratchet teeth 24 to be engaged by the pawl chisel point 28, the cam drum 12 is driven by the first frictional coupling 37; and, the second frictional coupling 51 permits shaft 14 to be overdriven by slippage therein.

When the ratchet wheel 25 and the cam track 52 have been manually used by the user the position causing the pawl chisel point 28 to be lifted from the ratchet teeth 24, driving of the ratchet wheel 25 in one direction by the pawl is prevented.

Thereafter, hub 36 driven by the coupling 51 in the reverse direction. The shaft 14 is then driven through coupling 37 in the reverse direction at the speed of rotation of the gear 40. The drum 12 continues rotating until the cam track 16 reaches the recessed cam track portion 17 whereupon cam follower drops and deactuates or opens switch 20 to cut line power to the motor drive (not shown) for the shaft 48.

In the presently preferred practice of the invention, the pawl and ratchet drive embodiment of the first advance means, e.g., the ratchet and pawl is operable to provide a faster rotation to cam drum 12 than the continuously rotating pinion gear 46 driving in the reverse direction through gear 40 and coupling 51. In one application of the invention, it has been bound desirable to rotate the eccentric shaft 30 at a rate of 4 revolutions per minute (4 RPM) thereby giving the pawl 26 a period of oscillation of 15 seconds.

For operation of the second advance means at the slower rate, and reverse direction, the driving pinion 46 is rotated at a rate of one-fifteenth revolution per minute (1/15 RPM); and, the ratio of the number of teeth on pinion 46 to the number of gear teeth 44 is 1:4 giving the gear 40 a rate of rotation of one-sixtieth revolution per minute (1/60 RPM).

When the motor drive (not shown) for driving eccentric shaft 30 and pinion 46 is inoperative, e.g., switch 20 is open, shaft 14 may be rotated by the appliance user in either direction. If the pawl 26 is in the lifted or engaged position shown in FIG. 1 and 2, coupling 37 will slip to permit positioning of the cam in either direction.

Referring to FIGS. 4 through 7, an alternate embodiment of the invention is illustrated at 100 as having a cam drum 112 on shaft 114 with program cam track 116 with a notch 117 provided therein for operating a cam follower 118 which is operative to effect actuation of an appliance function switch 120.

Cam drum 114 has attached thereto an auxiliary cam track 122 and a wheel having teeth 124 thereon and is rotatably mounted on base 119 and is adapted to be driven by a first advance means as will hereinafter be described.

An arm 126 is pivotally mounted on the programmer base or housing means 119 about an axis concentric with a motor driven pinion 131 rotating about shaft 130 and meshed with and engaging a driven gear 135 which is coupled to a shaft 133 journalled for rotation on the arm 126 near the cam following end 128 thereof. Shaft 133 extends through the arm 128 and has attached to the opposite end thereof a smaller driving pinion gear 139 which is adapted for engagement with the toothed member 124 as will hereinafter be described.

Toothed member 124 preferably a gear wheel is attached to the drum 112 for effecting rotation thereof when driven by pinion 139. In operation the auxiliary cam track 122 permits the follower 128 to drop permitting arm 126 to pivot and pinion 139 to engage the toothed member 124 in driving engagement, as shown in FIG. 4.

Referring to FIG. 6, pinion 139 drives the toothed gear member 124 through rotary friction coupling 137 and causes the friction coupling 151 to be overdriven and slip while motorized pinion 146 continues to drive gear 140 in a reverse direction.

Referring to FIG. 5, arm 126 has been lifted by the high portion 152 of the cam track 122 thereby disengaging pinion 139 from toothed gear member 124, thereby permitting gear 125 to rotate in the reverse direction with through gear 140 driven by pinion 146, rotary friction coupling 151; and, the shaft 114 is driven through rotary friction coupling 137. The embodiment of FIGS. 4, 5 and 6 thus provides an alternate first advance means for continuously driving the drum at the faster rate instead of employing the intermittent indexing of the ratchet and pawl drive mechanism of FIGS. 1 through 3.

Referring to FIG. 7, it will be understood that the faster rate of advance of the first advance means is employed when the indicator knob 15 is rotated clockwise for settings of zero through seven (0-7). The slower rate of advancement comprising the second advance means is employed when the knob is rotated counterclockwise for dial settings in the range zero to sixty (0-60). Thus, rotation of the knob 15 in the counterclockwise direction rotates the cam drum so that the auxiliary cam track 52 in the FIG. 1 embodiment and track 152 in the FIG. 4 embodiment lifts the ratchet pawl 28 or follower 128 to disengage the first advance means which may either be a pawl driven ratchet or a continuous gear drive.

The present invention provides a unique and novel dual rate drive for an electromechanical programmer for actuating appliance function switches in a sequence during a selected program interval. The programmer of the present invention provides a first advance means which is operative to advance a switch cam drum through a first frictional coupling to the cam drum shaft. Also, a second frictional coupling operates via separately continuously rotating motor driven gears. Upon engagement of the first advance means the first frictional coupling slips and is overdriven to permit the shaft to be driven in a reverse direction. User positioning of the cam drum is accomplished by permitting second frictional coupling 51 to slip upon user rotation of the cam drum shaft in either direction. User positioning of the cam drum in one direction engages the first advance means; whereas positioning in the opposite direction disengages the first advance means permitting the second advance means to rotate the cam drum.

The present invention has been hereinabove described with respect to the embodiments illustrated in the drawings which comprise the presently preferred practice. However, it will be understood by those skilled in the art that modifications and variations may be made to the illustrated embodiments disclosed version and the invention is limited only by the scope of the following claims.

We claim:

1. A bi-directional setting electromechanical interval programmer for an appliance comprising:

(a) housing means;

(b) program cam means including shaft means mounted for rotation on said housing means and having at least one program cam track thereon;

(c) at least one appliance program function switch including cam follower means responsive to said cam track for making and breaking a circuit;

(d) first advance means operative to drive said shaft through a first rotary frictional coupling, said advance means including drive pawl means movably mounted on said base means and ratchet means, said drive pawl means movable between a first position engaging said ratchet means and a second position disengaged from said ratchet means, said pawl means in said first position operative, upon driving oscillation, to advance said cam track in one direction;

(e) blocking means operative in response to user rotation of said shaft and cam means in one direction from a reference position for moving said pawl means to said second position, said blocking means upon user rotation of said shaft and cam means from said reference position in a direction opposite said one direction operative to move said pawl means to said first position;

(f) drive means operative upon energization to continuously drive said pawl means and said shaft means through a second rotary friction coupling, in a direction opposite said one direction when said pawl means is in said second position; and, (g) wherein said first rotary frictional coupling is operative to drive said shaft means and said second rotary friction coupling slips when said pawl means is in said first position and driving said ratchet means.

2. The programmer defined in claim 1, wherein said blocking means includes a separate cam track on said cam means and a cam follower operatively contacting said pawl means.

3. The programmer defined in claim 1, wherein said ratchet means comprises a ratchet wheel having a hub on said shaft and said second frictional coupling comprises a frictional engagement of said hub on said shaft.

4. The programmer defined in claim 1, wherein drive means includes a driven gear having a hub received over said shaft and said second rotary frictional coupling includes a frictional engagement of said gear hub with said ratchet means.

5. The programmer defined in claim 1, wherein said ratchet means first frictional coupling has a lesser breakaway torque than said second rotary frictional coupling.

6. A bi-directional setting interval programmer for an appliance comprising:

(a) housing means;

(b) program cam means including shaft means mounted for rotation on said housing means and having at least one program cam track thereon;

(c) at least one appliance program function switch disposed on said housing means having a cam follower responsive to said cam track;

(d) first advance means operative upon receipt of power to drive said shaft means through a first rotary frictional coupling and including a toothed member rotatable with said program cam means and having first driving means movably mounted on said housing means, said first driving means movable between a first position engaging and a second position disengaging said toothed member, said first driving means operative in said first position to advance said program cam means in only one direction of rotation;

(e) blocking means operative, in response to user rotation of said shaft means and program cam means in only one direction from a reference position, to move said driving means from said second position to said first position;

(f) second advance means operative, upon receipt of power, to continuously drive said shaft means and said program cam means through a second rotary frictional coupling in a direction opposite said one direction; and (g) means operable, upon energization to provide power to said first and second advance means, wherein said first frictional coupling is operative to drive said shaft means and said second rotary frictional coupling slips when said first driving means is in said first engaging position and advance said program cam means in said one direction, and when said first driving means is in said second disengaged position said second advance means operatively advances said program cam means through said second rotary frictional coupling in said opposite direction.

7. The programmer defined in claim 6, wherein said second frictional coupling drives through said first frictional coupling.

8. The programmer defined in claim 6, wherein second rotary frictional coupling has a significantly higher breakaway torque than said first rotary frictional coupling.

9. The programmer defined in claim 6, wherein said first frictional coupling comprises the inner periphery of a hub on said toothed wheel and a surface portion of said shaft means.

10. The programmer defined in claim 6, wherein said second rotary frictional coupling includes a driven gear with a hub having portions of the inner periphery thereof frictionally coupled to said shaft.

11. The programmer defined in claim 6, wherein said first driving means includes an oscillating pawl having the end thereof in said first position engaging said toothed member.

12. The programmer defined in claim 6, wherein said first driving means includes a member pivoted concentrically about the axis of an input gear and having a driven gear journalled for rotation on said member and continuously meshed with said driving gear, said driven gear engaging said toothed member in said first engaged position of said driving means.

13. The programmer defined in claim 6, wherein said second advance means advances said program cam means at a rate different from said first advance means.

* * * * *